United States Patent [19]

Birge

[11] Patent Number: 4,971,257

[45] Date of Patent: Nov. 20, 1990

[54] ELECTROSTATIC AEROSOL SPRAY CAN ASSEMBLY

[76] Inventor: Marc Birge, 8023 Crescent Dr., Clayton, Mo. 63105

[21] Appl. No.: 441,515

[22] Filed: Nov. 27, 1989

[51] Int. Cl.[5] ..... B05B 5/03; B05B 5/053

[52] U.S. Cl. ..... 239/708; 239/375; 222/402.15; 222/183; 118/629; 427/27

[58] Field of Search ..... 239/337, 375, 690, 708; 222/183, 402.13, 402.15; 118/629; 427/27

[56] References Cited

U.S. PATENT DOCUMENTS

| | | | |
|---|---|---|---|
| 2,914,221 | 11/1959 | Rosenthal | 239/690 X |
| 3,625,424 | 12/1971 | Mantica . | |
| 3,731,145 | 5/1973 | Senay . | |
| 4,098,436 | 7/1978 | Kohlbeck | 239/375 X |
| 4,258,655 | 3/1981 | Bagby et al. . | |
| 4,290,091 | 9/1981 | Malcolm . | |
| 4,476,515 | 10/1984 | Coffee . | |
| 4,549,243 | 10/1985 | Owen et al. . | |
| 4,611,762 | 9/1986 | Turner et al. | 239/690 X |
| 4,612,598 | 9/1986 | Norris . | |
| 4,613,075 | 9/1986 | Owen . | |
| 4,625,342 | 12/1986 | Gangnath et al. | 222/402.13 X |
| 4,740,799 | 4/1988 | Mason et al. . | |

FOREIGN PATENT DOCUMENTS 2038952 7/1980 United Kingdom ..... 222/402.15

*Primary Examiner*—Andres Kashnikow
*Assistant Examiner*—William Grant
*Attorney, Agent, or Firm*—Rogers, Howell & Haferkamp

[57] ABSTRACT

In an electrostatic particle spraying apparatus, a hand-held triggering mechanism is provided with a self-contained source of high D.C. voltage and a coupling sleeve into which a conventional aerosol spray can is inserted. A trigger mechanism is squeezed by a mechanism operator and closes a switch that completes an electrical connection between the D.C. voltage source and an electrode of the mechanism, creating an electric potential in the electrode. The electrode is positioned in the projected path of particle spray from the aerosol can, and continued depression of the trigger lever causes a hammer to contact and depress a nozzle tip of the aerosol can, releasing the pressurized fluid contents of the can from the nozzle tip in a projected path of particle spray. A distal end of the electrode extends into the projected path of particle spray. The electric potential of the electrode induces an electric charge of predetermined polarity in the spray of particles dispensed from the nozzle tip of the aerosol can thereby enhancing the atomization of the particles of spray and enhancing the depositing of the particles of spray on a grounded substrate surface.

23 Claims, 2 Drawing Sheets

ELECTROSTATIC AEROSOL SPRAY CAN ASSEMBLY

BACKGROUND OF THE INVENTION:

(1) Field of the Invention:

This invention relates to an electrostatic particle spraying apparatus, in particular, an apparatus where a conventional aerosol spray can is employed to dispense a spray of particles that are charged with a predetermined polarity by an electrode of the apparatus positioned in the projected path of particle spray from the aerosol can.

(2) Description of the Related Art:

Electrostatic particle spraying systems of the type provided by the present invention commonly comprise an electrostatic spray gun or a manually held particle spray directing device that employs a nozzle supplied with a pressurized fluid to be sprayed on a substrate surface. An operator selectively dispenses a fine spray of fluid particles from the spraying device in a projected path toward the substrate. Fluids commonly dispensed by such devices include paint and pesticides. An electrode selectively connected to a source of D.C. voltage is mounted to the device in a position proximate to the projected path of particle spray. The electrode is selectively connected to the source of D.C. voltage by a manually operated switch to produce a high D.C. potential in the electrode.

The high electric potential of the electrode induces an electric charge in the fluid particles that are sprayed from the nozzle of the device. The induced charge of the particles sprayed from the nozzle is of a predetermined polarity, and the like charge of the particles facilitates in the atomization of the fluid sprayed from the nozzle of the device. As is known in the art, the electrostatic charging of the fluid particles sprayed from the nozzle of the device enhances the depositing of the particles on a grounded substrate being sprayed.

The spray guns or spraying devices of conventional electrostatic particle spraying apparatus commonly use a source of D.C. voltage and a source of fluid to be sprayed that are both separate from the spray gun. These systems typically employ a power converter or booster that transforms the commercially available low A.C. voltage power to a high D.C. voltage to be supplied to the electrode of the gun. Spray guns of this type are commonly connected to separate voltage boosters or multipliers by bulky high voltage cables that extend between the voltage booster and the gun. Some conventional spray guns contain voltage boosters within the structure of the guns. These types of spray guns are commonly connected by low voltage wiring to a low voltage D.C. source that, in turn, is connected to a source of commercially available A.C. voltage power. The A.C. voltage is converted to a low D.C. voltage by the low voltage D.C. source, and the low D.C. voltage is supplied to the voltage multiplier contained in the gun where it is converted to the high D.C. voltage required to charge the electrode of the gun.

The source of fluid to be sprayed from the gun is also typically separate from the gun itself and is connected to the gun by a bulky supply hose. Electrostatic particle spraying apparatus of the type described above are disclosed in the U.S. Pat. Nos. 3,731,145; 4,258,655; and 4,613,075.

Conventional electrostatic particle spraying apparatus of the type described above are disadvantaged in that their connections to separate power and paint sources by bulky electric cables and fluid hoses render the spray guns awkward to manipulate during a particle spraying operation. Several types of electrostatic spraying apparatus have been developed in efforts to overcome the disadvantages of the above described electrostatic systems. These include electrostatic spraying apparatus having self contained voltage sources and self contained supplies of fluid to be sprayed. However, these self contained electrostatic spraying apparatus require specialized cannisters for their fluid supplies and are not readily adaptable to use with conventional aerosol spray cans of paint or pesticides.

The present invention overcomes the shortcomings of the prior art electrostatic particle spraying apparatus by providing a self contained hand-held electrostatic particle spraying device that is adapted to use a conventional aerosol spray can as its source of fluid particles to be electrostatically charged and has no bulky hose connection to an external fluid source. The spraying device of the present invention also comprises a self contained high D.C. voltage source and has no bulky electric cable connections to an external voltage source. The self contained source of high D.C. voltage is selectively connected to an electrode protruding into the projected path of particle spray from an aerosol spray can inserted into the device.

It is therefore an object of the present invention to provide an improved self contained electrostatic particle spraying apparatus that contains its own source of high D.C. voltage and its own source of fluid particles to be sprayed in the form of a conventional aerosol spray can. The apparatus is manually operated to spray fluid particles from the aerosol can in a projected path toward a grounded substrate while simultaneously inducing an electric charge of a predetermined polarity in the particles of fluid sprayed from the aerosol can to enhance the depositing of the charged particles on the substrate.

SUMMARY OF THE INVENTION:

The electrostatic particle spraying apparatus of the present invention includes a light-weight, hand-held spraying assembly having a self contained source of high D.C. voltage. The apparatus also includes a replaceable, self contained supply of fluid particles to be sprayed from the device as electrostatically charged particles onto a grounded substrate. The novel construction of the apparatus of the present invention eliminates the bulky electrical cables and fluid hoses employed in connecting prior art spraying apparatus to their separate supplies of high D.C. voltage and fluid to be sprayed.

The apparatus of the present invention includes a container sleeve that is dimensioned to receive a conventional aerosol spray can and hold the spray can in a fixed position relative to the apparatus. The sleeve has a top covering with a center opening through which the nozzle tip of an aerosol spray can extends when the can is inserted into the sleeve. The top covering prevents arcing from occurring between the metal top of the spray can and the electrode of the apparatus to be described later. An operator's handle is attached to the sleeve, the handle being dimensioned to be held in one hand by an operator of the apparatus. A source of high D.C. voltage such as a rechargeable battery electrically connected to a voltage multiplier are contained within the handle. The battery is easily removed from and replaced in the handle to permit periodic recharging of the battery.

A manually operated trigger is provided in the handle. Squeezing the trigger closes a microswitch that connects the battery to the voltage multiplier. The voltage multiplier supplies the multiplied D.C. voltage of the battery to an electrode positioned to charge fluid particles sprayed in a projected path from the nozzle of a conventional aerosol spray can held by the sleeve of the apparatus. Squeezing the trigger also simultaneously causes the apparatus to depress the nozzle tip of the spray can, causing the fluid particles to be sprayed from the can. In an alternate embodiment, squeezing the trigger initiates the spray of particles prior to the charging of the electrode. The manually operated trigger is essentially mechanically connected to a lever mechanism that contacts and depresses the nozzle tip of a conventional aerosol spray can held by the apparatus in response to the operator's squeezing the manual trigger.

In one embodiment, the electrode of the apparatus is supported in a portion of the lever mechanism that contacts and depresses the nozzle tip of the aerosol spray can. The electrode has a distal end that protrudes from the lever mechanism. The electrode moves into the projected path of particles sprayed from the aerosol can when the lever mechanism is caused to contact and depress the nozzle tip of the aerosol can in response to depression of the manual trigger. The electrode is electrically connected to a manual switch that is closed in response to depression of the trigger. Closing the switch connects the electrode to the voltage multiplier of the D.C. voltage source creating a high electric potential in the electrode.

In an alternate embodiment, the electrostatic particle spraying apparatus of the present invention includes a modified nozzle tip to be attached on the valve stem of a conventional aerosol spray can held by the apparatus sleeve. The modified nozzle tip includes an electrical contact plate embedded in a top surface of the nozzle tip. The tip also includes an electrode having a first end embedded in the tip and electrically connected to the contact plate. A second distal end of the electrode protrudes from the tip adjacent the tip nozzle and into the projected path of particle spray of the nozzle.

The lever mechanism of the alternate embodiment includes a second contact plate embedded in an end of the lever that is adjacent to, but spaced from, the first contact plate of the modified nozzle tip. The second contact plate is electrically connected to the microswitch that is responsive to depression of the manual trigger to complete an electrical connection between the second contact plate and the voltage multiplier of the D.C. voltage source.

On depression of the manual trigger by the apparatus operator, the microswitch is closed and the voltage multiplier of the D.C. voltage source is electrically connected to the second electric contact plate. Simultaneously, the lever mechanism is caused to pivot in response to depression of the manual trigger, and engage and depress the modified nozzle tip downward on the valve stem of the conventional aerosol spray can. The depression of the modified nozzle tip results in a spray of fluid particles from the nozzle of the modified tip. The lever mechanism's engagement with the modified tip also causes the second contact plate to engage the first contact plate, forming an electrical junction that completes an electrical connection between the electrode of the apparatus and the voltage multiplier of the D.C. voltage source. This electrical connection creates an electric potential in the electrode. The electric potential in the electrode induces an electric charge in the fluid particles in the projected path of spray from the modified nozzle tip. The electrically charged particles have a predetermined polarity that enhances the atomization of the particles sprayed from the tip and the deposition of the charged particles on a substrate that has been grounded.

In an alternate embodiment, the position of the microswitch relative to the manual trigger is changed so that the spray of particles from the aerosol can is initiated prior to the closing of the microswitch and the charging of the electrode.

In another embodiment, the electrode of the modified nozzle tip is again embedded in the nozzle tip and electrically connected to the first contact plate at the top surface of the tip. However, in this embodiment, the second end of the electrode extends into the interior of the modified tip and protrudes into a fluid conduit in the tip that directs the flow of fluid released from the aerosol can through the tip and out the tip nozzle. In this embodiment, the particles of fluid are charged by the electrode prior to their being sprayed from the nozzle tip.

In a still further embodiment, the modified tip is provided with a horizontal disk that is positioned just above the portion of the tip stem that is inserted into the valve stem of the aerosol can contained in the sleeve of the apparatus. The disk prevents arcing from occurring between the electrode of the modified tip and the metal top of the aerosol can. In this and the other embodiments of the modified tip discussed above, the modified tip is constructed of a material having a high insulating value to prevent arcing and charring of the tip.

When the supply of fluid contained in the conventional aerosol spray can has been exhausted, the operator need only replace the aerosol spray can with a new can having a conventional nozzle tip in the case of the first embodiment of the invention, or replace the aerosol spray can with a new can having the conventional nozzle tip replaced by the modified nozzle tip of the present invention in the case of the alternate embodiments of the invention.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
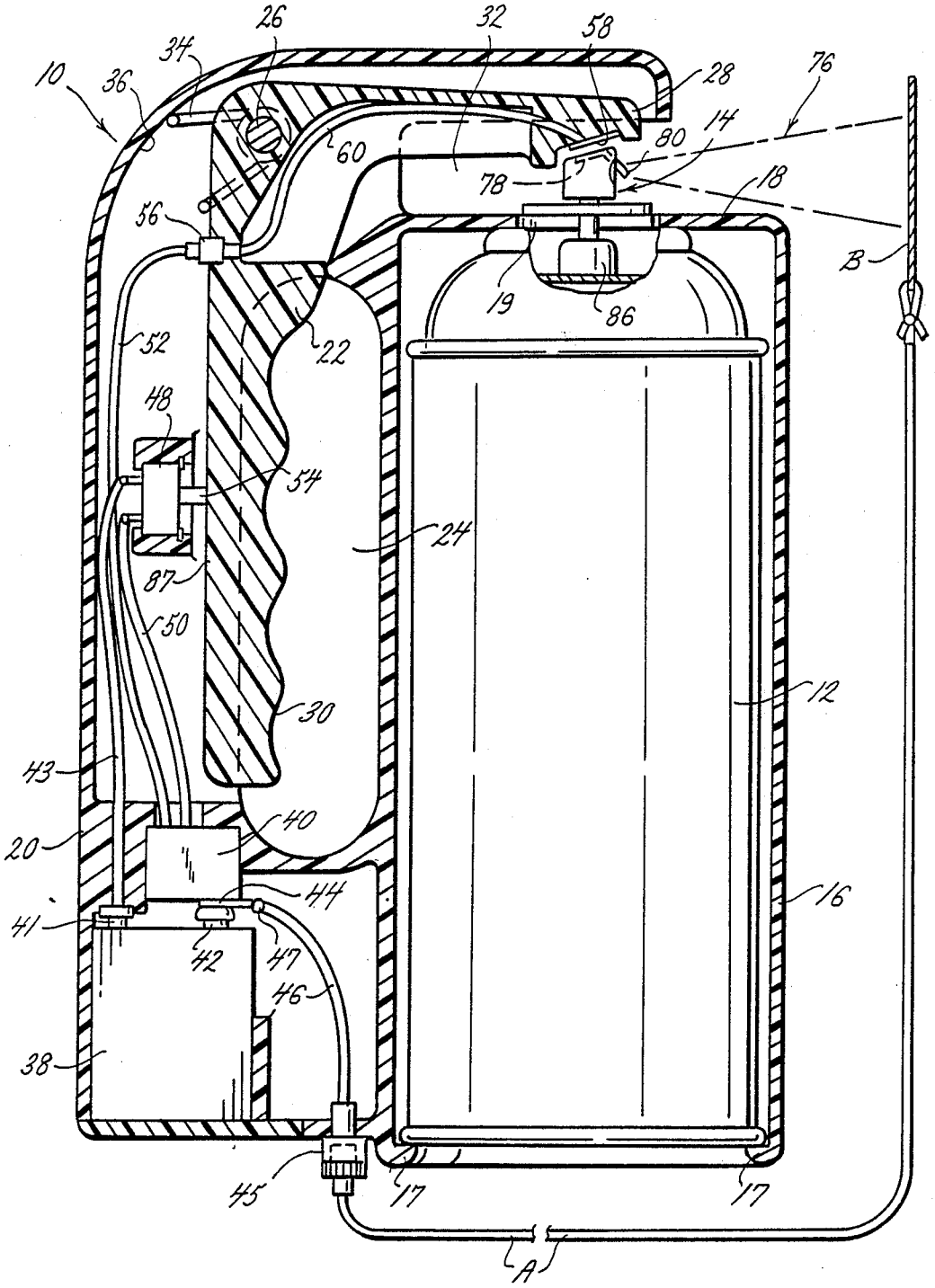
FIG. 1 is a side elevation view in section of the electrostatic particle spraying apparatus of the present invention.

FIG. 1 shows the electrostatic particle spraying apparatus of the present invention. The first embodiment of the spraying apparatus comprises a hand-held triggering mechanism 10 that has a conventional aerosol spray can 12 attached to it. A modified nozzle tip 14 replaces the conventional nozzle tip of the aerosol spray can to accommodate the can to the electrostatic particle charging system to be explained later.

The hand-held triggering mechanism 10 includes an aerosol can coupling sleeve 16 at its right end as viewed in FIG. 1. The sleeve 16 is dimensioned to receive a conventional aerosol spray can inserted into the sleeve, and includes a pair of clips 17 at the bottom of the sleeve that hold the can stationary in the sleeve. The coupling sleeve 16 also includes a top covering 18 with a center opening 19 through which the nozzle tip 14 of the aerosol can contained in the sleeve extends. The top covering 18 prevents arcing between the top of the aerosol can and an electrode to be described later. A pistol-grip type handle 20 is provided on the triggering mechanism opposite the coupling sleeve.

A pivoting trigger lever 22 extends through a slot 24 from the interior of the triggering mechanism. The trigger lever 22 is pivotally mounted on a pivot pin 26 and includes a hammer section 28 positioned opposite the pivot pin 26 from the trigger section 30 of the trigger lever 22. The hammer 28 extends through a second slot 32 to a position just above the coupling sleeve center opening 19. A coil spring 34 is mounted on the pivot pin 26 and engages the trigger lever 22 and an interior surface 36 of the trigger mechanism housing. The spring 34 biases the trigger lever 22 counterclockwise to the position shown in FIG. 1 with the trigger 30 spaced to the right to its furthest extent from the handle 20 of the trigger mechanism, and the hammer 28 spaced to its furthest extent above the sleeve center opening 19. An abutment can be provided in the triggering mechanism to prevent further counterclockwise rotation of the trigger lever. By depressing the trigger 30 to the left as viewed in FIG. 1, the trigger lever 22 is pivoted clockwise about the pivot pin 26 against the bias of the spring 34, and the hammer 28 moves downward toward the coupling sleeve 16.

A high voltage D.C. power source including a rechargeable D.C. battery 38 and a conventional voltage multiplier 40 are provided in the triggering mechanism. The positive terminal 41 and the negative terminal 42 of the battery are electrically connected to the voltage multiplier 40 by electrical conductors 43,44, respectively. The electrical connection of the negative terminal is also grounded to the substrate to be sprayed by an electrical connection between the substrate and a ground post 45 at the bottom of the handle exterior. The post is a conventional screw threaded terminal with a hand turned nut that is tightened down on the screw threads to hold one end of a separate electrical conductor A to the terminal. The opposite end of the electrical conductor A is to be attached to the substrate B to be grounded. The post 45 is connected inside the handle to the negative terminal of the battery by an electrical conductor 46 and a junction 47 joining the conductor 46 to the conductor 44. The electrical connection between the positive terminal 41 of the battery 38 and the voltage multiplier 40 is controlled by the microswitch 48. Closing the switch completes the electrical connection between the conductor 43 leading from the positive terminal of the battery, and the conductor 50 leading to the voltage multiplier.

The high D.C. voltage output of the multiplier is supplied to the electrical conductor 52 when an actuator 54 of the microswitch 48 is depressed by leftward movement of the trigger 30 as viewed in FIG. 1. The electrical conductor 52 is connected with a junction terminal 56 mounted on the trigger mechanism 22. The junction terminal 56 is electrically connected to an electronic contact plate 58 on the hammer head 28 of the trigger lever 22 by the electrical conductor 60. By depressing the spring biased actuator 54 of the microswitch 48, the voltage multiplier 40 is electrically connected to the battery 38 and supplied with a low D.C. voltage. The voltage multiplier converts the supplied low D.C. voltage to a high D.C. voltage and supplies the high voltage to the contact plate 58 by way of the electrical conductor 52, the electrical junction terminal 56, and the electrical conductor 60.

Figure 2:
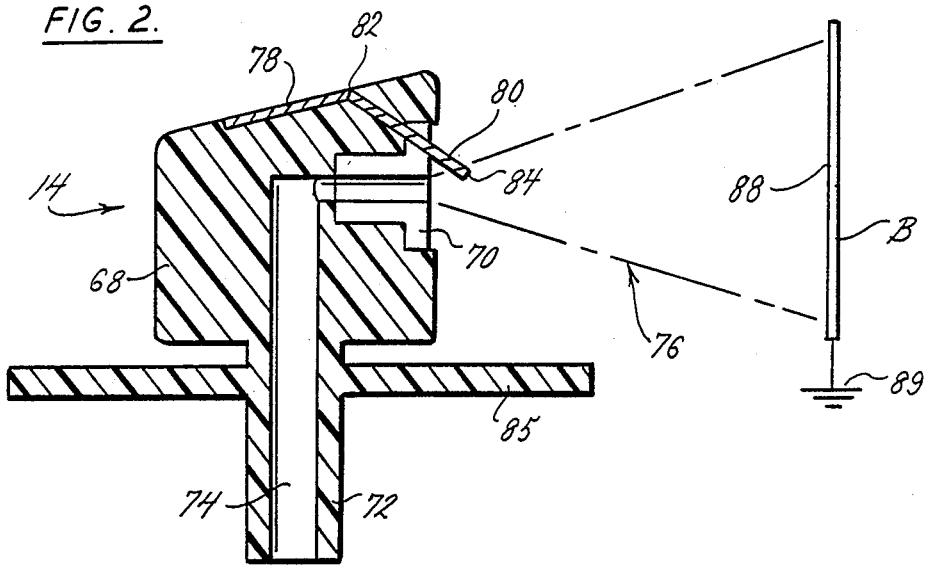
FIG. 2 is a side elevation view in section of the modified nozzle tip of the present invention.

The modified nozzle tip 14 of the present invention is shown in FIG. 2. The nozzle tip is similar to a conventional nozzle tip in that it includes a head portion 68, a nozzle 70 inserted in the head portion, a tubular post 72 that is inserted into the valve stem of a conventional aerosol can to couple the nozzle tip to the can, and a fluid conduit 74 extending through the nozzle tip to direct pressurized fluid released from the aerosol can through the nozzle tip to the nozzle 70 which dispenses the fluid released from the can as a particle spray along a projected path 76.

What differentiates the modified nozzle tip 14 from conventional nozzle tips is that it also comprises an electrical contact plate 78 embedded in the top surface of the tip, and an electrode 80 extending through the nozzle 70 and the head portion 68 of the nozzle tip. The electrode 80 is electrically connected to the electrical contact plate 78 at its first end 82, and extends into the projected path of particle spray from the nozzle tip at its second distal end 84. The modified tip also includes an insulating disk 85 that extends radially outward from the tubular post 72 and prevents arcing from occurring between the electrode 80 and the top of the aerosol can that the tip is connected to. The modified nozzle tip is intended to replace a conventional nozzle tip supplied with a conventional aerosol spray can to adapt the aerosol spray can for use with the electrostatic particle spraying apparatus of the present invention.

In operation, the conventional nozzle tip provided with a commercially available aerosol spray can is first replaced by the modified nozzle tip of the present invention. The conventional tip supplied with the can is removed by pulling the nozzle tip from the valve stem 86 of the can 12. With the conventional nozzle tip removed, the modified nozzle tip 14 is then attached to the conventional spray can 12 by inserting the tubular post 72 of the tip on the valve stem 86 of the can, and rotating the modified tip on the valve stem to seat the tip completely on the stem. With the modified tip 14 positioned on the valve stem 86, the aerosol can is next attached to the triggering mechanism 10 of the invention by inserting the can 12 into the interior of the sleeve 16, simultaneously inserting the modified tip 14 through the center opening 19 in the top cover 18 of the sleeve 16. The insulating disk 85 of the modified tip has a diameter that just passes through the center opening. Alternatively, the modified tip can be formed without the insulating disk. If a tip without a disk is used, the center opening 19 of the sleeve top cover 18 can be reduced in size so that the tip just passes through the opening 19 and the top cover 18 prevents arcing between the electrode and the can tip.

With the aerosol can attached to the triggering mechanism, the modified tip 14 is next turned to properly orient the tip relative to the mechanism with the nozzle 70 and electrode 80 of the tip pointed away from the triggering mechanism, as seen in FIG. 1. Orienting the modified valve tip 14 completes the assembly of the conventional aerosol can 12 to the electrostatic particle spraying apparatus of the present invention, and the apparatus is now ready for use.

To operate the electrostatic particle spraying apparatus, the operator first connects a separate electrical connector A, such as a length of wire, between the substrate B to be sprayed and the post 45 grounding the battery of the triggering mechanism 10. This establishes a grounding connection between the substrate and the negative terminal of the D.C. power source.

By squeezing the trigger 30 with the fingers, the operator pivots the trigger lever 22 clockwise about the pivot point 26, as seen in FIG. 1. As the trigger pivots, the hammer electrical contact plate 58 in the head of the hammer 28 contacts the tip electrical contact plate 78 on the top surface of the modified nozzle tip 14. The engagement of the two contact plates establishes an electrical connection between two plates. Simultaneously, a rear surface 87 of the trigger lever, to the left of the trigger as seen in FIG. 1, contacts and depresses the actuator 54 of the microswitch 48.

As the button is depressed, the switch establishes an electrical connection between conductors 43 and 50, supplying low D.C. voltage to the voltage multiplier 40. The voltage multiplier converts the low D.C. voltage to high D.C. voltage, and supplies the high D.C. voltage to the distal end 84 of the electrode 80 by the electrical conductor 52, the junction terminal 56, the electrical conductor 60, the contact plate 58, the contact plate 78, and the electrode 80.

With the electrode 80 electrically connected to the high D.C. voltage source, an electric potential builds up in the distal end 84 of the electrode. Upon further depression of the trigger 30, the trigger lever continues to pivot about the pivot point 26 and depresses the modified nozzle tip 14 downward onto the valve stem 86 of the aerosol spray can 12. With continued downward depression of the valve stem, the valve of the aerosol spray can is opened, releasing the pressurized fluid contents of the can to the conduit 74 of the modified nozzle tip. The pressurized fluid is directed by the conduit 74 through the nozzle 70 and is dispensed from the nozzle as a particle spray along the projected path 76.

Due to the electric potential of the electrode 80 extending into the projected path of the particle spray, the particles sprayed from the nozzle 70 each have an induced electrical charge. The like charge of the particles enhances the atomization of the fluid spray dispensed from the nozzle, and also enhances the depositing of the particles of spray on a substrate surface 88 that has been grounded 89, as previously described.

Figure 3:
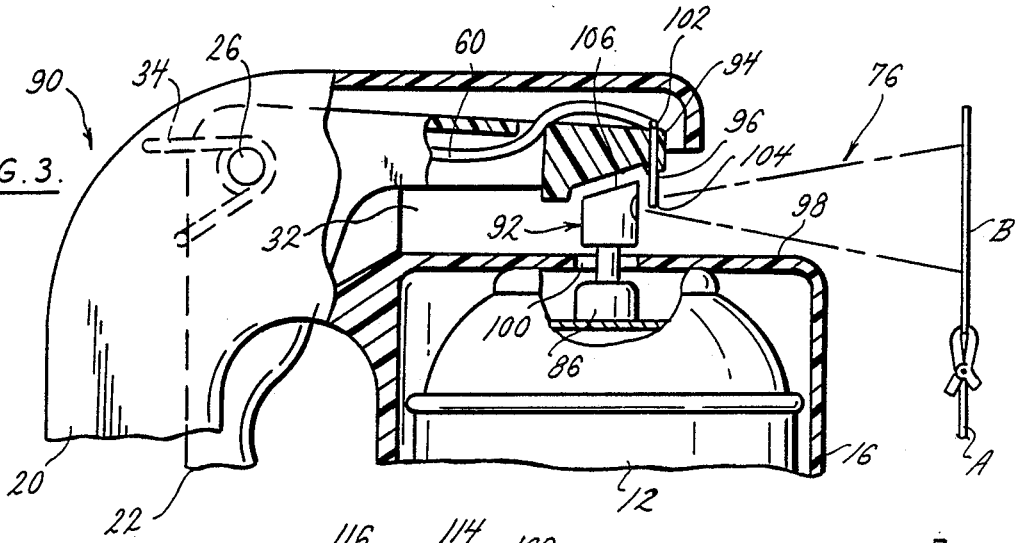
FIG. 3 is a side elevation view in section of an alternate embodiment of the present invention.

FIG. 3 shows an additional embodiment of the hand-held triggering mechanism 90 of the present invention. This embodiment of the invention is substantially the same as the first embodiment, except that it is designed to induce an electrostatic charge in particles of spray projected from a conventional nozzle tip 92 of a conventional aerosol spray can without the use of the modified nozzle tip of the first embodiment. This embodiment employs a trigger lever 22 with a hammer head 94 having an embedded electrode 96. As can be seen in FIG. 3, this additional embodiment of the invention otherwise employs substantially the same components as the first embodiment, and like reference numerals refer to identical components found in both embodiments of the invention.

The additional embodiment of the invention employs a conventional aerosol spray can 12 with the conventional nozzle tip 92 of the spray can still attached to the valve stem 86. The can is inserted into the coupling sleeve 16 of the triggering mechanism 90 in the identical manner as set forth in the description of the first embodiment of the invention. The top cover 98 of this embodiment has a much smaller center opening 100 to permit the passage of the conventional tip 92 through the opening, while sufficiently covering the top of the can to prevent arcing between the electrode and the top of the can. Following the connection of the can 12 to the triggering mechanism 90, the conventional nozzle tip 92 provided with the can is oriented properly relative to the triggering mechanism 90 so that the projected path of particle spray from the can is directed away from the triggering mechanism as seen in FIG. 3.

The only other component of this embodiment of the invention that is not identical to the first embodiment is the structure of the trigger lever hammer section 94. The hammer 94 of the second embodiment does not comprise a contact plate, but instead supports the electrode 96. The electrode is connected to the electrical conductor 60 at a first end 102, and is positioned in the hammer slightly to the right of the nozzle tip 92 as viewed in FIG. 3. The second end 104 of the electrode extends downward from the hammer in front of the nozzle tip 92 and into the projected path of particle spray 76 from the nozzle tip. The electrode 96 is connected through the electrical conductor 60, the junction terminal 56, and the electrical conductor 52 to the voltage multiplier 40.

In operation, as in the first embodiment, the operator grips the handle 20 of the triggering mechanism, placing his fingers over the trigger 30 of the trigger lever 22. The negative terminal 42 of the D.C. voltage source is grounded to the substrate B by a separate electrical conductor A. As in the first embodiment, the operator squeezes the trigger lever 22, causing it to rotate about the pivot point 26 against the bias of the spring 34. The clockwise rotation of the trigger lever about the pivot point causes the rear surface of the trigger lever 87 to pivot clockwise and contact the actuator 54 of the switch 48. Continued rotation of the trigger lever depresses the actuator 54 and closes the switch 48, completing an electrical connection between the positive terminal 41 of the D.C. voltage source 38 and the voltage multiplier 40. The D.C. voltage supplied to the voltage multiplier is converted to a high D.C. voltage and is supplied to the electrode 96 by the electrical conductor 52, the electrical junction terminal 56, and the electrical conductor 60. As in the first embodiment, completing this electrical connection produces an electric potential in the distal end of the electrode.

Continued depression of the trigger 30 by the operator causes the trigger lever to continue to pivot clockwise about the pivot point 26 until the hammer 94 contacts the top surface 106 of the nozzle tip. In this position, with the hammer 94 just contacting the top surface of the nozzle tip, the distal end of the electrode 104 is properly positioned in front of the nozzle and in the projected path of particle spray from the nozzle. On continued depression of the trigger and continued clockwise rotation of the trigger lever about the pivot point, the hammer 94 depresses the nozzle tip 92 downward on the valve stem 86 of the aerosol can, causing the valve to release the pressurized fluid contents of the can, and the nozzle tip 92 sprays the contents as a particle spray along the projected path 76 of the nozzle.

With the second end of the electrode 104 extending into the projected path of the particle spray, the electric potential of the electrode induces an electrical charge in each of the particles sprayed from the nozzle tip. The like positive charge of each of the particles enhances the atomization of the sprayed particles dispensed from the nozzle tip, and also enhances the depositing of the charged particles on a substrate surface 88 that has been grounded 89, as previously described.

When the contents of the aerosol can 12 have been emptied, the operator need only release the trigger lever 22 which will cause the hammer 94 and the electrode 96 to pivot counterclockwise away from the nozzle tip 92 due to the bias of the spring 34. The operator may then remove the empty can from the trigger mechanism 90 and replace it with a full can to continue the particle spraying operation.

In an additional embodiment, the closing of the microswitch 48 in response to the operator's squeezing of the trigger lever 22 is delayed, so that particle spray from the aerosol can is initiated a short time interval prior to the closing of the switch and the charging of the electrode.

Figure 4:
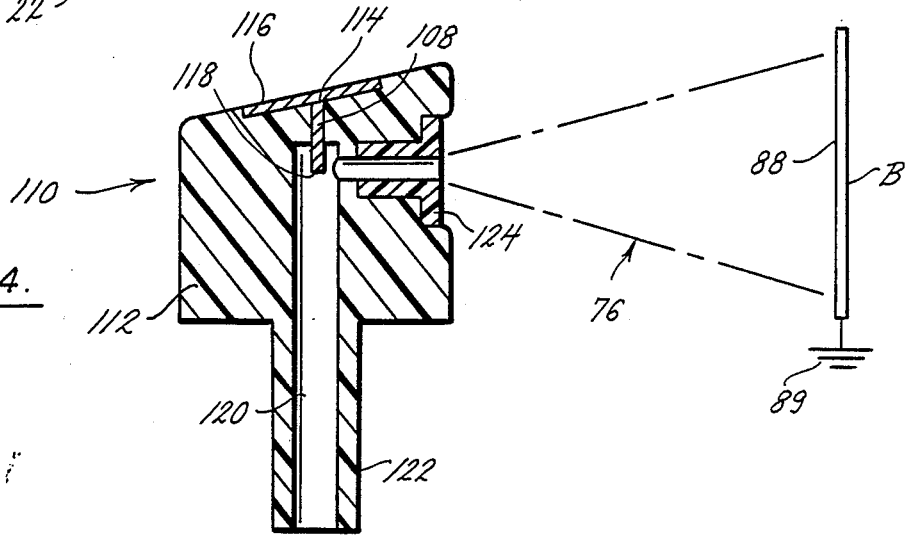
FIG. 4 is a side elevation view in section of another embodiment of the modified nozzle tip of the present invention.

In another embodiment shown in FIG. 4, the electrode 108 of the modified tip 110 is again embedded in the nozzle tip 112 and electrically connected at its first end 114 with the contact plate 116 on the top surface of the tip. In this embodiment, the second end 118 of the electrode extends into the interior of the modified tip and protrudes into the fluid conduit 120 that directs the flow of fluid released from the aerosol can through the tubular post 122 and the tip and out the tip nozzle 124. In this embodiment, the particles of fluid are charged by the electrode 108 prior to their being sprayed from the tip.

In this and the other previously described embodiments of the modified tip discussed above, the modified tip is constructed of a material having a high insulating value to prevent arcing and charring of the tip.

While the present invention has been described by reference to specific embodiments, it should be understood that modifications and variations of the invention may be constructed without departing from the scope of the invention defined in the following claims.

What is claimed is:

1. An electrostatic particle spraying apparatus for use with aerosol spray cans, the apparatus comprising:

a hand-held coupling mechanism adapted to be connected to an aerosol can and to hold the can in a fixed position relative to the apparatus;

a tip adapted to be attached onto a valve stem of an aerosol can connected to the mechanism, and to be supplied with the contents of the can when the valve stem is opened;

a nozzle in fluid communication with the tip and adapted to spray the contents of the can supplied to the tip in a projected path away from the nozzle; and an electrode adapted to be connected to a voltage source, the electrodes having a distal end extending into the projected spray path of the nozzle and spaced a predetermined distance from the nozzle.

2. The apparatus of claim 1 comprising:

a voltage source adapted to be selectively electrically connected to the electrode to establish an electric potential in the electrode and induce an electric charge of a predetermined polarity in fluid particles sprayed from the nozzle.

3. The apparatus of claim 1 comprising:

the tip having an electrically conductive contact on its surface, the contact being electrically connected to the electrode.

4. The apparatus of claim 1 comprising:

a manually operated trigger mounted on the hand-held mechanism and a mechanical connection between the trigger and the tip, the mechanical connection being adapted to depress the tip and open the valve stem in response to depression of the trigger by an operator, and the mechanical connection being adapted to separate from the tip and close the valve stem in response to release of the trigger by an operator.

5. The apparatus of claim 4 comprising:

a voltage source;

a first electric contact on an exterior surface of the tip and electrically connected to the electrode, a second electric contact on an exterior surface of the mechanical connection adjacent the first contact and electrically connected to the voltage source, the firs and second contacts being adapted to engage and establish an electrical connection between the voltage source and the electrode to create an electric potential in the electrode in response to depression of the trigger by the operator.

6. The apparatus of claim 5 comprising:

the first and second contacts being adapted to engage and create an electric potential in the electrode prior to depression of the tip and opening of the valve stem by the mechanical connection in response to depression of the trigger by an operator.

7. The apparatus of claim 3 comprising:

the electrically conductive contact being positioned on a top surface of the tip, and the electrode extending through the tip from a first end connected to the contact to a second end protruding from the tip adjacent the nozzle and into the projected spray path.

8. An electrostatic particle spraying apparatus arranged to induce a charge of predetermined polarity in particles sprayed from a conventional aerosol spray can, the can having a valve stem and a nozzle tip on the valve stem that dispenses pressurized contents of the can in a projected path as a spray of particles when the nozzle tip is pressed downward on the stem, the apparatus comprising:

a can holding and spraying means adapted to hold a conventional aerosol spray can in a fixed position relative to the apparatus to enable directing a projected path of particle spray from the can, and adapted to selectively depress a nozzle tip on an aerosol can held by the holding means to dispense the can contents in a projected path as a spray of particles;

a voltage source; and an electrode means having a first end that is selectively electrically connected to the voltage source and a second end that protrudes into a flow path of particles sprayed from a nozzle tip on an aerosol can held by the holding means, the electrode being adapted to be charged to an electric potential and to induce an electric charge of predetermined polarity in particles sprayed from an aerosol can held by the holding means when the electrode is connected to the voltage source.

9. The apparatus of claim 8 comprising:

a modified nozzle tip adapted to be pressed downward on a valve stem of a conventional aerosol can to dispense the can contents in a projected path as a spray of particles, the modified tip having a first electrically conductive contact plate on its exterior surface electrically connected to the first end of the electrode.

10. The apparatus of claim 9 comprising:

the electrode being partially embedded in the modified tip, with the second end of the electrode protruding from the modified tip and into the projected path of particles sprayed from the tip.

11. The apparatus of claim 9 comprising:

the electrode being embedded in the modified tip, with the second end of the electrode extending into a fluid conduit that conveys the contents of the can through the modified tip when the tip is pressed downward on the 12. The apparatus of claim 9 comprising:

a manual lever means pivotally connected to the can holding means, the lever means being adapted to engage and press downward on a modified tip pressed on a valve stem of a conventional aerosol spray can held by the holding means in response to manual manipulation of the lever 13. The apparatus of claim 12 comprising:

the manual lever means having a second electrically conductive contact plate on its exterior surface positioned adjacent to and spaced from the first contact plate and adapted to be selectively connected to the voltage source, the second contact plate engaging and forming an electrically conductive junction with the first contact plate when the manual lever means engages and presses downward on the modified tip pressed on a valve stem of an aerosol can held by the holding means.

14. The apparatus of claim 8 comprising:

a manual switch arranged to selectively close an electric connection between the voltage source and the electrode and to open the electric connection between the voltage source and the electrode.

15. The apparatus of claim 8 comprising:

the voltage source being a completely self-contained unit on the can holding and spraying means.

16. The apparatus of claim 8 comprising:

a manual lever means pivotally connected to the can holding and spraying means, the lever means being adapted to engage and press downward on a nozzle tip on a valve stem of a conventional aerosol spray can held by the holding and spraying means in response to manual manipulation of the lever means, the electrode being fixed stationary relative to the lever means, and the second end of the electrode protruding into a projected path of particles sprayed from a nozzle tip when the lever means engages and presses downward on a nozzle tip.

17. An electrostatic particle spraying apparatus for use in inducing an electric charge in particles of fluid sprayed from a conventional aerosol spray can having a valve stem and a nozzle tip attached on the stem for dispensing fluid contents of the can through and out of the nozzle tip as a spray of fluid particles when the nozzle tip is pressed downward on the stem, the apparatus comprising:

a modified nozzle tip to be attached to a valve stem of a conventional aerosol spray can;

a conduit passing through the modified tip and arranged to receive fluid contents from the can, and to dispense the received contents from the modified tip as a spray of fluid particles in a projected path when the modified tip is pressed downward on the valve stem;

an electrically conductive plate on an exterior surface of the modified tip; and an electrode adapted to be connected to a voltage source, the electrode being mounted on the modified tip, the electrode having first and second ends with the first end of the electrode being electrically connected to the conductive plate.

18. The apparatus of claim 17 comprising:

the electrode being partially embedded in the modified tip, and the second end of the electrode protruding from the modified tip and extending into the projected path of particle spray from the modified tip.

19. The apparatus of claim 18 comprising:

the conductive plate being arranged to be electrically connected to a source of voltage, and the electrode being arranged to be charged to an electric potential and to induce an electric charge in fluid particles dispensed from the modified tip as a spray in the projected path when the conductive plate is electrically connected to a source of voltage.

20. The apparatus of claim 17 comprising:

the electrode being completely embedded in the modified tip, and the second end of the electrode protruding into the conduit passing through the modified tip and into fluid contents received in the modified tip.

21. The apparatus of claim 20 comprising:

the conductive plate being arranged to be electrically connected to a source of voltage, and the electrode being arranged to be charged to an electric potential and to induce an electric charge in fluid particles dispensed from the modified tip as a spray in the projected path when the conductive plate is electrically connected to a source of voltage.

22. The apparatus of claim 19 comprising:

the modified tip having a tubular post adapted to be attached to a valve stem of a conventional aerosol spray can and to be pressed downward on the stem to dispense fluid contents from the spray can and supply the fluid contents to the conduit of the modified tip, the tubular post having an insulating member extending radially outward from the post and insulating the electrode from an aerosol can to which the modified tip is attached.

23. The apparatus of claim 17 comprising:

the modified tip being constructed of an electrically insulating material.

* * * * *